United States Patent [19]

Rabe

[11] 4,140,341

[45] Feb. 20, 1979

[54] COLLAPSIBLE WHEEL CHAIR FRAME HAVING TELESCOPING POSTS

[75] Inventor: Adolph A. Rabe, Savage, Minn.

[73] Assignee: Theradyne Corporation, Lakeville, Mich.

[21] Appl. No.: 838,643

[22] Filed: Oct. 3, 1977

[51] Int. Cl.[2] ..... A47C 4/42

[52] U.S. Cl. ..... 297/45; 297/DIG. 4

[58] Field of Search ..... 297/45, DIG. 4, 345; 248/158, 161, 414; 403/109

[56] References Cited

U.S. PATENT DOCUMENTS

| | | | |
|---|---|---|---|
| 2,486,015 | 10/1949 | Everest et al. | 297/DIG. 4 |
| 2,947,556 | 8/1960 | Wenger | 248/161 X |
| 3,059,888 | 10/1962 | Lic | 248/161 |
| 3,265,346 | 8/1966 | Petrick | 248/414 |
| 3,278,229 | 10/1966 | Bates | 297/345 |
| 4,042,250 | 8/1977 | Rodaway | 297/45 |

*Primary Examiner*—Francis K. Zugel

*Attorney, Agent, or Firm*—Orrin M. Haugen; Thomas J. Nikolai

[57] ABSTRACT

A frame for a collapsible wheel chair which permits custom tailoring of the chair to the size of the invalid with only minor modifications. The frame includes telescoping front posts which support horizontally extending arms to which a flexible seat is secured. A pair of cross struts are provided which are rotatably secured to the horizontally extending arms and to the bottom struts of the frame. When the chair is collapsed by bringing the two sides of the chair frame together, the telescoping post permits the horizontal arms to raise a distance determined by the length of the cross struts. Thus, during manufacture, the only parts that need be custom made to accommodate differing sized invalids is the length of the cross struts.

1 Claim, 5 Drawing Figures

COLLAPSIBLE WHEEL CHAIR FRAME HAVING TELESCOPING POSTS

BACKGROUND OF THE INVENTION

I. Field of the Invention

This invention relates generally to the design of a wheel chair frame and more specifically to a folding-type wheel chair frame having a portion thereof supported by telescoping posts which thereby enables the width of the chair to be adjusted, while continuing to use conventional "X" cross members to permit collapsing of the chair in a single assembly.

II. Description of Prior Art

A typical prior art collapsible wheel chair frame over which the present invention is deemed to be an improvement is described in the McClintock U.S. Pat. No. 3,331,614. The frame of the McClintock Patent comprises first and second sides coupled together by pivoting cross members. The cross members connect from a bottom strut on a first side to a vertically moving seat support member on the opposite side. The chair is collapsed by moving one side towards the other and in doing so, the seat support rails on either side move upward. A means is provided for the invalid to adjust the width of his chair by turning a crank operated threaded screw which couples the slidable seat frame to the stationary arm rests.

It is to be especially noted that in the frame design disclosed in the McClintock Patent the height of the seat is inversely related to the width of the chair. That is, the wider the chair, the lower the seat and vice versa. It is also to be noted that the height of the arm rests with respect to the seat is also a function of the chair width.

Because of the dimensions of the human body, for maximum comfort, the distance between the arm rests and the seat should remain constant independent of the overall width of the chair. Then too, most invalids prefer not to sit too high in the chair because of a fear of tipping due to the high center of gravity.

The wheel chair frame designed in accordance with the teachings of the present invention allows the seat height with respect to the arm rests to remain constant independent of chair width when in its operable position. Furthermore, the seat height with respect to the ground also remains constant. However, when it is desired to collapse the folding wheel chair for transportation or the like, this can be accomplished quite readily.

SUMMARY OF THE INVENTION

The collapsible wheel chair frame of the present invention comprises first and second sides which are identical in construction to one another and include horizontal bottom struts to which front and rear vertically extending posts are connected. The front post of each side includes a telescoping member which adjustably connects the seat supporting rails which are adapted to slide up and down with respect to the rear posts or struts. Cross members pivotally secure the bottom strut of a first side to the seat supporting rail of the opposite side such that the chair can be collapsed, irrespective of the length of the cross members which are custom designed in length to accommodate the size of the invalid who will be using the chair.

When the chair using the frame of the present invention is in its operative position to transport an invalid, the seat will be a pre-designed distance below the level of the arm rests and above the ground. Thus, many different chairs having identically constructed side members can be built to accommodate a variety of wheel chair patients of differing stature and the only custom made parts of the frame are the cross members. Accordingly, manufacturing costs can be reduced while still providing a wheel chair frame which is designed for maximum comfort of a wide variety of invalids.

Other objects and advantages of the invention will become apparent to those skilled in the art from a reading of the following detailed description of the preferred embodiment taken in conjunction with the accompanying drawings in which:

DESCRIPTION OF THE PREFERRED EMBODIMENT

Figure 1:
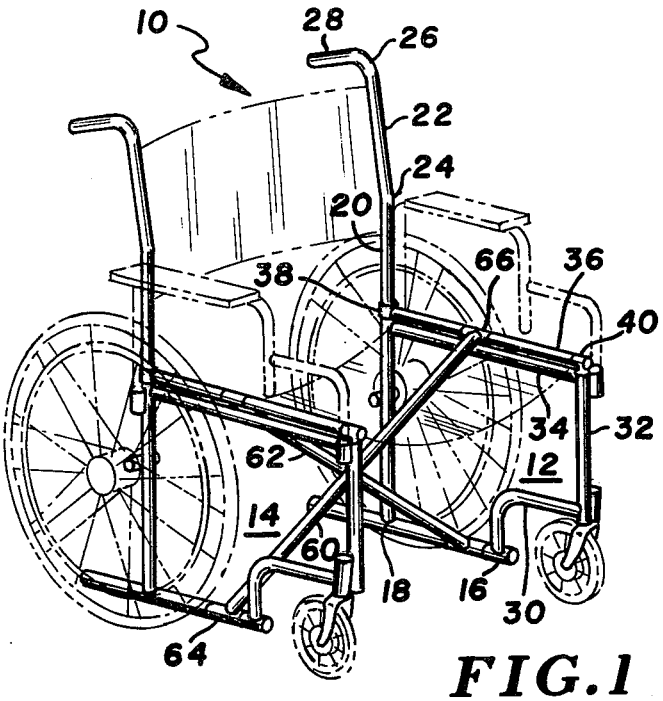
FIG. 1 is a perspective view of the wheel chair frame.

Referring first to FIG. 1, there is shown a perspective view of the structural elements comprising the collapsible wheel chair frame of the present invention. As is illustrated, the frame, indicated generally by numeral 10, is comprised of two side members 12 and 14 which are identically constructed. Hence, only the details of the side 12 will be described, it being understood that the description applies equally to the construction of side 14. The side 12 includes a tubular bottom strut 16 which may be formed from aluminum or other suitable metal. Welded to or otherwise affixed to the bottom strut 16 at a point 18 is a vertically extending back strut 20, also fabricated from extended metal tubing, which is disposed generally at right angles to the bottom strut 16. The rear tubular strut 20 is designed to be of a suitable length and an upper segment 22 thereof is bent slightly rearward at the point 24 and extends a second predetermined distance upward and backward where it is bent at point 26 to provide a handle grip area 28.

Also welded or otherwise affixed to the tubular bottom strut 16 is a L-shaped member 30 which connects to a first tubular front strut 32. The front strut 32 projects upwardly from the horizontally disposed leg of the L-bracket 30 for a predetermined distance.

A horizontally extending support rail 34 is connected between the rear vertical strut 20 and the first tubular front strut 32. The support rail 34 is also formed from an extruded metal tube and may be welded in place or secured between the struts 20 and 32 by a suitable fastening means (not shown). The side frame 12 further includes a horizontally disposed moveable top tubular strut 36 which is connected at a first end to a circular or C-shaped bracket 38 which either totally or partially encompasses the rear strut 20 so as to be slidable therealong.

Figure 4:
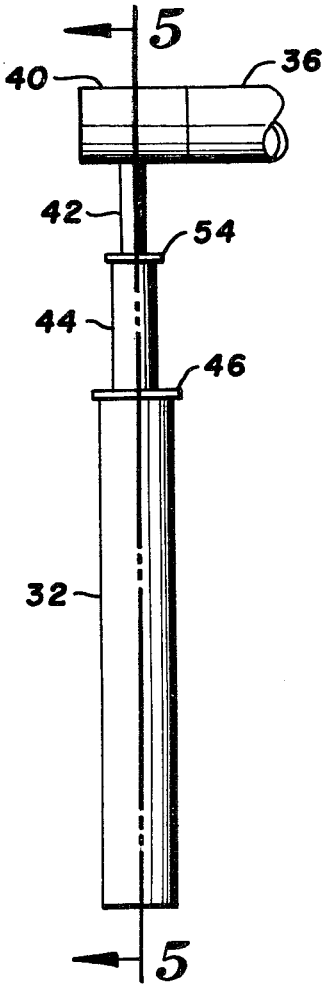
FIG. 4 is an enlarged detailed view of the telescoping front strut members used in the frame of FIG. 1.

Secured to the opposite end of the strut 36 is a tubular bracket 40, better shown in the enlarged view of FIG. 4. The tubular strut 36 passes through the bracket 40 in the manner illustrated. The bracket 40, in turn, is welded to a second tubular front strut 42 which extends downward from the top strut 36 at substantially a right angle. The length of the second tubular front strut member 42 is such that it telescopically engages the first tubular front strut member 32. This telescoping arrangement is more clearly illustrated in the crosssectional view of FIG. 5.

Figure 5:
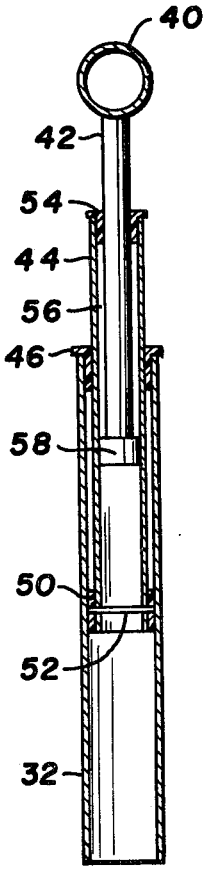
FIG. 5 is a cross-sectional view of the front strut member of FIG. 4.

With respect to FIG. 5, it can be seen that the first tubular front strut member 32 has an inside diameter of a sufficient size to receive the outside diameter of an intermediate telescoping tube 44. The inside diameter of the intermediate tube 44 is appropriately sized such that the second front tubular strut member 42 may pass through it.

In order to ensure smooth telescopic extension and compression of the members 32, 42 and 44, a first cylindrical bushing 46 is provided which is inserted in the space 48 between the inner surface of the tube 32 and the outer surface of the tube 44. A second cylindrical bushing 50 is secured to the lower end of the intermediate tube 44 by means of a pin 52 which passes diametrically through the tube 44 and into the cylindrical bushing 50. Similarly, a cylindrical bushing 54 is disposed in the space 56 between the outside surface of the tubular front strut 42 and the inside surface of the intermediate tubular member 44. An end slide 58 is attached to the bottom end of the strut 42 by any suitable means and maintains the tube 42 coaxial with respect to the axis of the intermediate tube 44.

The bushings 46, 50 and 54 as well as the end slide member 58 are preferably formed from a plastic material such as nylon and are dimensioned to permit a snug but slidable fit between the associated mating members. The pin 52 passing through the tube 44 serves as a stop for the second tubular strut member 42 when it is in its collapsed position with respect to the tube 44 and further downward force on the strut 42 will cause the intermediate tubular member 44 to be collapsed into the first tubular front strut 32.

Referring back to the pictorial view of FIG. 1, the frame 10 further includes first and second cross struts 60 and 62. The cross strut 60 is rotatably affixed to the bottom strut of the side 14 and to the top strut 36 of the side 12 by means of a tubular bracket 64 which surrounds the bottom strut of side 14 and a corresponding tubular bracket 66 which is affixed to the other end of the cross strut 60 to encompass the strut 36. In a similar fashion, the cross strut 62 is rotatably coupled to the bottom strut 16 of the frame side 12 and to the arm rail of the side 14. Again, tubular brackets provide an excellent means of obtaining the desired rotational coupling.

Because the invention resides in the novel construction of the frame, it is not deemed necessary to explain in detail the other parts comprising the completed wheel chair. However, for ease of visualization, the drawings of FIGS. 1, 2 and 3 depict by a phantom line representation the manner in which the rear and front wheels, the seat, and the seat back are disposed with respect to the frame 10.

Figure 2:
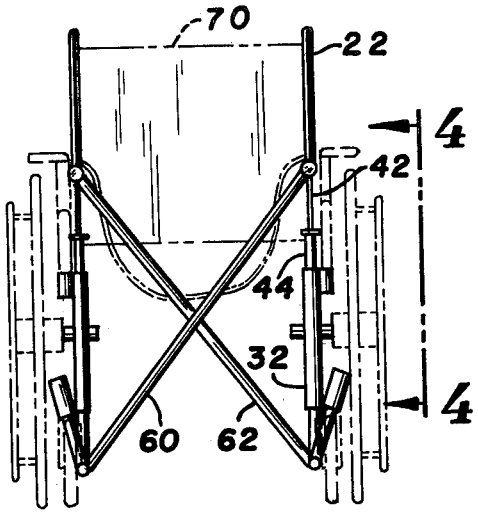
FIG. 2 is a front elevation of the wheel chair frame in a partially collapsed position.
Figure 3:
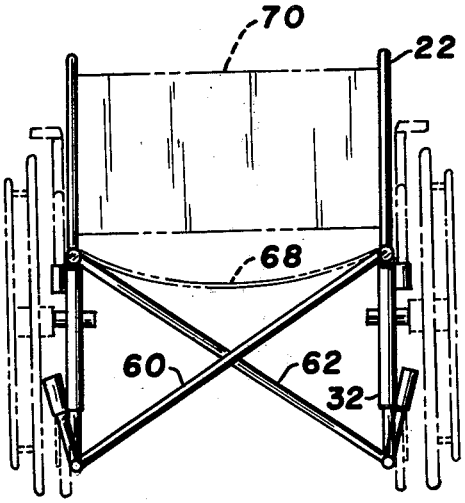
FIG. 3 is a front elevation view of the preferred embodiment with the frame in its fully extended position.

As perhaps can best be seen in FIG. 2, the flexible seat pad represented by phantom lines 68 is affixed at opposite ends to the tubular top struts 36 on the frame sides 12 and 14. Also, the flexible seat back 70 is attached by rivets, snaps, or otherwise to the rear struts 20.

Now that the details of the construction of the wheel chair frame of the preferred embodiment has been described in detail, consideration will next be given to its operation and to the various advantages afforded thereby.

OPERATION

To obtain economies in scale in the manufacture of an item such as a collapsible wheel chair, it is, of course, desirable to use standardized parts, rather than having to custom make a wheel chair to fit invalids of various sizes. However, where personal comfort is concerned, it is not possible to design a standard size chair for use by all individuals. For example, if a standard size chair is made to accommodate an obese individual, its width may be too great to comfortably contain a person of a slighter frame and vice versa.

The present invention solves this problem by permitting standardized parts to be utilized in the fabrication of the two sides 12 and 14 of the wheel chair. To accommodate individuals of differing widths and to thereby customize the chair to the invalid, it is only necessary to provide cross braces 60 and 62 of custom made length. As can be seen from the front view of FIG. 3, it is the length of the cross members 60 and 62 which determine the overall width of the chair when it is in its fully extended position. By providing the telescoping elements as the front vertical struts of the chair and by providing a slidable connection between the top strut 36 and the rear struts 20, a chair of any given fully extended width can be collapsed, irrespective of the length of the cross members 60 and 62.

FIG. 2 illustrates the wheel chair in its partially collapsed position. Here, the sides 12 and 14 are forced together and in doing so, the cross braces 60 and 62 rotate about the bottom struts 16 and top struts 36 as the top struts 36 move upward and the telescoping elements 32, 44 and 42 are extended. By providing a double telescoping unit, i.e., intermediate tubular member 44 within the lower front strut 32 and the upper front strut 42 within the intermediate member 44, a significant extension can be obtained to permit the top tubular struts 36 to slide sufficiently high up on the rear struts 20 so that the collapsed width of the chair is a minimum.

In extending the chair frame, the side members 12 and 14 are pulled apart from one another and this exerts a downward force on the top tubular struts 36 through the action of the rotatable cross members 60 and 62. The downward force causes the top struts to slide downward about the rear struts 20 and the telescoping elements 42 and 44 to be collapsed into the first front tubular strut member 32.

Thus it could be seen that the design of the present invention permits wheel chairs of varying widths to be produced economically, the only custom made parts being the cross members 60 and 62 as well as the upholstery including the seat 68 and the back 70. The side members 12 and 14, including all of the parts comprising same, remain fixed independent of the width that the chair is being designed for. It is also to be noted that the chair is no higher in its folded position than it is when it is in its fully extended position. Hence, storage, shipping and carrying in an automobile is facilitated.

While the invention has been particularly shown and described with reference to a preferred embodiment thereof, it will be understood by those skilled in the art that the foregoing and other changes in form and detail may be made therein without departing from the spirit and scope of the invention.

What is claimed is:

1. A frame for a folding-type wheelchair comprising, in combination:

(a) first and second side members, each including 1. a tubular bottom strut,
2. a rear tubular strut fixedly attached to said bottom tubular strut and extending upwardly therefrom,
3. a first front tubular strut fixedly attached to said bottom tubular strut and extending upwardly therefrom for a predetermined distance,
4. a tubular top strut having first and second ends, said first end slidably engaging said rear tubular strut, said top strut extending forwardly therefrom and being aligned substantially parallel to said bottom strut,
5. a second tubular front strut coupled to said second end of said tubular top strut and extending downward therefrom a predetermined distance, and
6. a tubular member having an outer diameter less than the inner diameter of said first front tubular strut and an inner diameter greater than the outer diameter of said second front tubular strut, said tubular member being telescopically inserted into said first front tubular strut and said second front tubular strut being telescopically inserted into said tubular member;

(b) a first tubular cross member rotatably coupled to the bottom tubular strut of said first side member and to the tubular top strut of said second side member; and (c) a second tubular cross member rotatably coupled to the bottom tubular strut of said second side member and to the tubular top strut of said first side member, said frame further including, a first cylindrical bushing disposed between said tubular member and said second front tubular strut;

a second tubular bushing disposed between said tubular member and said first front tubular strut; and a slide member secured to the lower end of said second front tubular strut, said slide member having a diameter slightly less than said inner diameter of said tubular member;

said first and second bushings and said slide member being formed from a nylon plastic material;

and a third tubular bushing disposed between said tubular member and said first front tubular strut and secured to the lower end of said tubular member by a pin passing diametrically through said tubular member and into said third tubular bushing.

* * * * *